US010190449B2

(12) United States Patent
Kim et al.

(10) Patent No.: US 10,190,449 B2
(45) Date of Patent: Jan. 29, 2019

(54) APPARATUS AND METHOD OF CONTROLLING ELECTRONIC CONTINUOUSLY VARIABLE VALVE TIMING

(71) Applicant: HYUNDAI KEFICO CORPORATION, Gunpo, Gyeonggi-do (KR)

(72) Inventors: Lae Kyeom Kim, Gangwon-do (KR); Nam Kyu Kim, Seoul (KR)

(73) Assignee: HYUNDAI KEFICO CORPORATION, Gunpo, Gyeonggi-do (KR)

( * ) Notice: Subject to any disclaimer, the term of this patent is extended or adjusted under 35 U.S.C. 154(b) by 113 days.

(21) Appl. No.: 15/285,027

(22) Filed: Oct. 4, 2016

(65) Prior Publication Data

US 2017/0096918 A1 Apr. 6, 2017

(30) Foreign Application Priority Data

Oct. 5, 2015 (KR) ..... 10-2015-0139855

(51) Int. Cl.
*F01L 9/04* (2006.01)
*F01L 1/047* (2006.01)
(Continued)

(52) U.S. Cl.
CPC ..... *F01L 9/04* (2013.01); *F01L 1/047* (2013.01); *F01L 1/344* (2013.01); *F01L 1/352* (2013.01);
(Continued)

(58) Field of Classification Search
CPC ... F01L 9/04; F01L 1/047; F01L 1/344; F01L 2009/0478; F01L 2013/103;
(Continued)

(56) References Cited

U.S. PATENT DOCUMENTS 8,468,990 B2 6/2013 Yang et al.
9,021,995 B2 5/2015 Golz
(Continued)

FOREIGN PATENT DOCUMENTS

CN 102777248 B 6/2014
DE 102006016650 A1 10/2007
(Continued)

*Primary Examiner* — J. Todd Newton
(74) *Attorney, Agent, or Firm* — Mintz Levin Cohn Ferris Glovsky and Popeo, P.C.; Kongsik Kim; Jhongwoo Jay Peck

(57) ABSTRACT

An apparatus and method of controlling an electronic continuously variable valve timing (CVVT) is provided. The apparatus includes a sensor disposed in a motor facing a reducer and an intelligent motor controller. The sensor determines a rotation speed of a first and second projection of a first and second rotation member and generates a sensing signal that corresponds to an output waveform of each rotation speed and inputs the signal to an intelligent motor controller coupled to the motor. The intelligent motor controller receives the signal and separates a crank shaft and cam shaft position signal. The signals are compared to detect an actual phase angle of the suction or exhaust valve. A phase deviation between the detected, actual and predetermined target phase angle is calculated.

10 Claims, 7 Drawing Sheets

(51) Int. Cl.

| | |
|---|---|
| ***F01L 1/344*** | (2006.01) |
| ***F02D 41/00*** | (2006.01) |
| ***F01L 1/352*** | (2006.01) |
| *F02D 41/20* | (2006.01) |

(52) U.S. Cl.
CPC .... *F02D 41/009* (2013.01); *F01L 2009/0478* (2013.01); *F01L 2800/00* (2013.01); *F01L 2800/14* (2013.01); *F01L 2820/041* (2013.01); *F01L 2820/042* (2013.01); *F02D 2041/001* (2013.01); *F02D 2041/2027* (2013.01); *F02D 2250/12* (2013.01)

(58) Field of Classification Search
CPC ..... F01L 2013/111; F01L 2013/113; F01L 2201/00; F01L 2800/14; F01L 2820/032; F01L 2820/041
USPC ..... 123/90.17, 90.15, 90.31
See application file for complete search history.

(56) References Cited

U.S. PATENT DOCUMENTS

| | | | | |
|---|---|---|---|---|
| 2009/0101095 | A1* | 4/2009 | Inoue | F01L 1/344 123/90.17 |
| 2010/0162980 | A1* | 7/2010 | Mashiki | F01L 1/34 123/90.17 |
| 2012/0291722 | A1* | 11/2012 | Kanda | F02D 13/0238 123/41.02 |
| 2013/0008397 | A1 | 1/2013 | Takada | |
| 2013/0055973 | A1 | 3/2013 | D'epiro et al. | |
| 2015/0345345 | A1* | 12/2015 | Showalter | F01L 1/34 123/90.11 |
| 2017/0037745 | A1* | 2/2017 | Baek | F01L 1/34 |
| 2017/0096918 | A1* | 4/2017 | Kim | F01L 9/04 |
| 2017/0362968 | A1* | 12/2017 | Baek | F02D 13/0219 |
| 2018/0003089 | A1* | 1/2018 | Kim | H02K 11/215 |
| 2018/0003113 | A1* | 1/2018 | Baek | F01L 13/0015 |

FOREIGN PATENT DOCUMENTS

| | | | |
|---|---|---|---|
| DE | 102011051268 | A1 | 12/2012 |
| DE | 112013005398 | T5 | 8/2015 |
| EP | 2386729 | A1 | 11/2011 |
| JP | 2002-130005 | A | 5/2002 |
| JP | 2006-220079 | A | 8/2006 |
| KR | 10-2000-0010335 | A | 2/2000 |

* cited by examiner

APPARATUS AND METHOD OF CONTROLLING ELECTRONIC CONTINUOUSLY VARIABLE VALVE TIMING

CROSS-REFERENCE TO RELATED APPLICATIONS

This application claims priority under 35 U.S.C. § 119 to Korean Patent Application No. 10-2015-0139855, filed on Oct. 5, 2015, the disclosure of which is incorporated herein by reference in its entirety.

BACKGROUND

Field of the Invention

The present invention relates to an apparatus and method of controlling an electronic continuously variable valve timing (CVVT), and more particularly, to a sensor and a motor coupled to a reducer by using an electrical signal to adjust a timing of a cam shaft of a combustion engine.

Description of the Related Art

Typically, in automotive engineering, variable valve timing (VVT) control technology describes technology that adjusts timing for opening and closing a value abased on revolutions of a combustion engine. Since the VVT control technology adjusts a period of opening and closing a valve based on low-speed revolutions and high-speed revolutions of an engine, both fuel efficiency and an output of a vehicle is increased.

Generally, in engines a valve opening and closing timing is defined to obtain a maximum output in specific revolutions per minute (RPM) band. In other words, the valve opening and closing timing should extend for expansion and explosion of a mixer in a low RPM band, and in a high RPM band, the valve opening and closing timing should be shortened for emission of an exploded mixer. When a period of opening and closing a valve is adjusted to a low speed, emission of the mixer is later in a high RPM band. When the period of opening and closing the valve is adjusted to a high speed, compression of the mixer is later in a low RPM band, causing a reduction in efficiency of an engine. The VVT control technology has been proposed to solve the above mentioned limitations. The VVT control technology adjusts an opening and closing timing of a valve to match revolutions of an engine. Accordingly, a high fuel efficiency and a high output are simultaneously obtained at both a high speed and a low speed.

In particular, an operation of changing a VVT is performed at two stages for example, a low-speed rotation and a high-speed rotation. Recently, a CVVT-enabled CVVT system is being generalized. Additionally, the CVVT system may be named VVT, CVVT, CVTC, and VANOS. The CVVT system is a system that continuously adjusts an opening and closing timing of a valve according to revolutions of an engine and a degree to which an accelerator is opened. The CVVT system includes an interior chamber coupled to a cam shaft, an external system that coupled a timing system (e.g., a chain, a belt, etc.) and is configured to be supplied with power from an engine, a sensor configured to measure a current timing, and a control device. The control device includes a hydraulic type control and is equipped with an oil control valve (OCV). Recently, the control device includes a control device configured to adjust the performance of an electric motor to improve response characteristics of the motor.

In an electric motor control type CVVT system of the related art, an electronic control unit (ECU) of a vehicle receives revolutions of a cam shaft from the sensor disposed proximate to the cam shaft and receives revolutions of a crank shaft from a second senor disposed proximate to the crank shaft. The electric motor control type CVVT system is configured to calculate various control values to adjust an electric motor based on a result of the calculation. However, in the CVVT system of the relate art, an arithmetic operation to adjust the electric motor increases an operational load performed by the ECU and the arithmetic operation increases an operation error of the ECU and decreases a processing speed of the ECU. In particular, the first sensor disposed proximate to the cam shaft and the second senor disposed proximate to the crankshaft respectively transmit the revolutions of the cam shaft and the revolutions of the crank shaft to the ECU. The ECU is configured to perform an arithmetic operation on the revolutions of the cam shaft and the revolutions of the crank shaft. Additionally, the ECU is configured to calculate the various control values to adjust the electric motor. Therefore, signal delay occurs in a transmission process, and the signal delay decreases the processing speed of the ECU.

The matters disclosed in this section are merely for enhancement of understanding of the general background of the invention and should not be taken as an acknowledgment or any form of suggestion that the matters form the related art already known to a person skilled in the art.

SUMMARY

The present invention provides an apparatus and method of controlling an electronic CVVT. In particular, an intelligent motor controller is configured to operate with or operate independently from an ECU and a sensor electrically connected to the intelligent motor controller, decrease an operational load by the ECU based on an adjustment of a CVVT and rapidly increase a processing speed for the CVVT.

In an exemplary embodiment, an apparatus that adjusts an electronic continuously variable valve timing (CVVT) may include a motor and a reducer to adjust a relative rotation phase of a cam shaft rotating in cooperation with a crank shaft of a combustion engine to adjust a valve timing of a suction valve or an exhaust valve. Additionally, a sensor may be disposed in a border of a side of the motor facing the reducer and configured to sense a rotation speed of a first projection of a first rotation member which is coupled to the crank shaft to rotate and configured to sense a rotation speed of a second projection of a second rotation member which is gear-coupled to the first rotation member at a certain gear ratio and is coupled to the cam shaft to rotate. A sensing signal may be generated that corresponds to an output waveform which corresponds to each of the rotation speed and the sensing signal may be output therefrom. Further, an intelligent motor controller may be configured to receive the sensing signal from the first sensor, separate a crank shaft position signal corresponding to a rotation of the first projection and a cam shaft position signal corresponding to a rotation of the second projection from the sensing signal may be separated by the intelligent motor controller. The intelligent motor controller may be configured to compare the crank shaft position signal and the cam shaft position signal to detect an actual phase angle of the suction valve or the exhaust valve and may be configured to calculate a phase deviation between the detected actual phase angle and a predetermined target phase angle. The intelligent motor controller may be coupled to the motor and the first projection and the second projection may be disposed along a circumferential direction of a side of the reducer facing the motor.

The first projection may be included in one of a plurality of projection groups. The plurality of projection groups may be disposed along the circumferential direction on a side of the first rotation member facing the motor and may be spaced apart from each other. The plurality of projection groups may be disposed at a spacing angle with respect to a center of the first rotation member. The first rotation member may include an arc-shaped slot disposed between adjacent projection groups. The second projection may have an arc-shaped length greater than the first projection and may be configured to translate along the arc-shaped slot at a rotation angle approximately the same as a rotation angle of the cam shaft. The second projection may have a length less than an aperture length of the arc-shaped slot and the second projection may be exposed through the arc-shaped slot and may be sensed by the sensor.

The intelligent motor controller may include an actual phase angle (APA) detector. In particular, the APA detector may include a signal separator configured to separate the crank shaft position signal and the cam shaft position signal from the output waveform that corresponds to the sensing signal. A signal operator may be configured to perform an arithmetic operation or a comparison operation on the crank shaft position signal and the cam shaft position signal to detect the actual phase angle.

In another aspect, an electronic continuously variable valve timing (CVVT) control method performed by an electronic CVVT control apparatus may include adjusting by a motor and a reducer a relative rotation phase of a cam shaft rotating in cooperation with a crank shaft of a combustion engine to adjust a valve timing of a suction valve or an exhaust valve, sensing, by a sensor coupled to the motor a rotation speed of a first projection disposed in a first rotation member which is coupled to the crank shaft to rotate, time-serially sensing a rotation speed of a second projection disposed in a second rotation member which is gear-coupled to the first rotation member at a certain gear ratio and is coupled to the cam shaft to rotate, generating a sensing signal that corresponds to an output waveform, and inputting the sensing signal to an intelligent motor controller coupled to the motor. Additionally, the APA detector may include separating a crank shaft position signal that corresponds to a rotation of the first projection and a cam shaft position signal that corresponds to a rotation of the second projection from the sensing signal by using a signal separator of the intelligent motor controller, comparing the crank shaft position signal and the cam shaft position signal to detect an actual phase angle of the suction valve or the exhaust valve by using a signal calculator and calculating a phase deviation between the detected actual phase angle and a predetermined target phase angle. Further, the intelligent motor controller may be configured to calculate a duty value to adjust a motor torque of the motor based on the calculated phase deviation.

The calculating of the duty value may include receiving the predetermined target phase angle through the digital serial communication of CAN communication and RS-485 communication, detecting the actual phase angle based on the crank shaft position signal and the cam shaft position signal from the sensor and calculating the phase deviation between the target phase angle and the actual phase angle. Additionally, the calculation may include setting an addition or subtraction torque value for an output torque of the cam shaft based on the calculated phase deviation and calculating a duty value that corresponds to the addition or subtraction torque value. Other features and aspects will be apparent from the following detailed description, the drawings, and the claims.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Hereinafter, the exemplary embodiment of the present invention will be described in detail with reference to the accompanying drawings to allow those skilled in the art to easily practice the present invention. Advantages and features of the present invention and methods for achieving the same will be clearly understood with reference to the following detailed description of embodiments in conjunction with the accompanying drawings. However, the present invention is not limited to the embodiments disclosed herein, but may be implemented in various different forms. The embodiments are merely given to make the disclosure of the present invention complete and to completely instruct the scope of the invention to those skilled in the art, and the present invention should be defined by the scope of the claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

Figure 1:
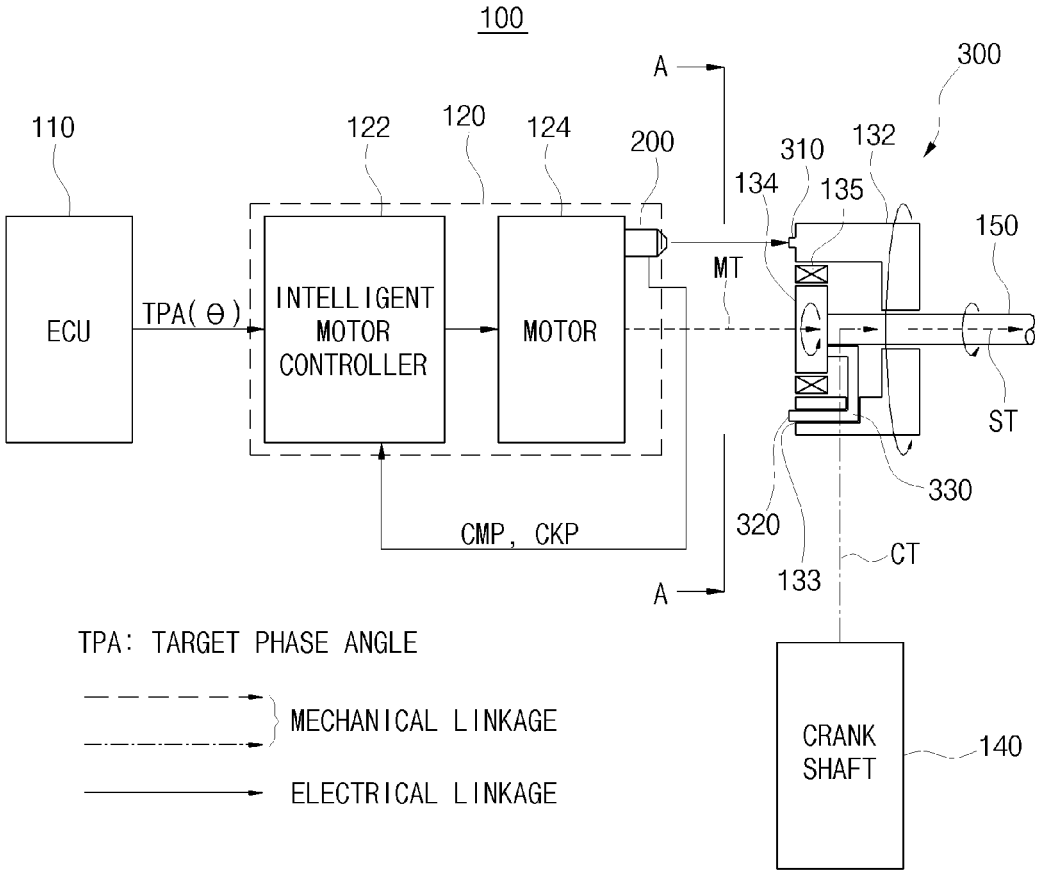
FIG. 1 is an exemplary block diagram illustrating a whole configuration of an electronic CVVT control apparatus according to an exemplary embodiment of the present invention.

FIG. 1 is an exemplary block diagram illustrating a whole configuration of an electronic CVVT control apparatus 100 according to an exemplary embodiment of the present invention. Referring to FIG. 1, the electronic CVVT control apparatus 100 according to an exemplary embodiment of the present invention may include an electronic control unit (ECU) 110, a motor controller module 120, a cycloid reducer (hereinafter referred to as a reducer) 300, and a crank shaft 140 and a cam shaft 150 of a combustion engine. In particular, the reducer 300 may be a gear train or a general reducer having planetary gears. The electronic CVVT control apparatus 100 may be an apparatus configured to adjust a relative rotation phase of the cam shaft 150 rotating in cooperation with the crank shaft 140 via a motor 124 of the motor controller module 120 and the reducer 300 to adjust a valve timing of a suction valve or an exhaust valve.

The ECU 110 may be configured to communicate with the motor controller module 120 through vehicle network communication that may include controller area network (CAN) communication. The ECU 110 may be configured to supply a predetermined target phase angle TPA (θ) to the motor controller module 120 through the vehicle network communication. The motor controller module 120 may be configured to output a motor torque MT to adjust a relative rotation speed of the motor 124 with respect to a rotation speed of the cam shaft 150. For example, the motor controller module 120 may include an intelligent motor controller 122, the motor 124, and a sensor 200 coupled to the motor 124 to face the reducer 300.

The motor 124 may be configured to output the motor torque MT to adjust the relative rotation speed of the motor 124 with respect to the rotation speed of the cam shaft 150 based on a driving current from the intelligent motor controller 122. A sensor installation component at the position where the sensor 200 may be disposed in an integration type may be provided on a first side of a casing of the motor 124 and a controller installation component where the intelligent motor controller 122 may be disposed may be provided on a second side of the casing. A brushless direct current (DC) motor (BLDCM) or a direct current motor may be disposed between the sensor installation component and the controller installation component.

The sensor 200 may be provided as a single unit. The sensor 200 may be configured as an inductive sensor. In other words, the sensor 200 according to the exemplary embodiment may sense multiple measurement targets (e.g., a first projection 310 and a second projection 320) on the same rotation line (e.g., a circumferential direction of a side of the reducer 300) to generate an output waveform. The sensor 200 maybe configured to provide feedback (e g , immediately or real time) based control by the motor 124, to be quickly and accurately detect performance based on multiple signals (e.g., a crank shaft position signal CKP and a camp shaft position signal CMP) in a subsequent process. Accordingly, the sensor 200 may be differentiated from a conventional crank shaft position sensor and a conventional cam shaft position sensor.

In particular, the first projection 310 and the second projection 320 may be disposed along the circumferential direction of the side of the reducer 300 facing the motor 124 and their detailed descriptions will be described in detail with reference to FIG. 3. The sensor 200 may be a type of speed sensor configured to sense a variation of a magnetic flux based on a projection shape to generate an output waveform. For example, the sensor 200 may be configured to sense a variation of a magnetic flux based on a different in the distance that occurs in a predetermined distance (e.g., an air-gap) between a rotating reducer and a hall integrated chip (e.g., IC, not shown) that may be configured to be turned on and off to generate an electrical signal (e.g., a sensing signal) that has a frequency variation based on a rotation speed or a sensing signal.

The sensor 200 may include a crank shaft position sensor that may be configured to sense a rotation speed of a crank shaft and a cam shaft position sensor that may be configured to sense a rotation speed of a cam shaft. In particular, the sensor 200 may be disposed in a border of a side of the motor 124 facing the reducer 300. Additionally, since the sensor 200 may be an integration type disposed in the border of the side, the sensor 200 to face the reducer 300 may be simplified and a performance deviation may be reduced. The sensor 200 and reducer 300 may maintain an interval that corresponds to the predetermined distance (e.g., an air-gap). The sensor 200 may be configured to sense a rotation speed of the first projection 310 disposed in a first rotation member 132. For example, the first rotation member 132 may be coupled to the crank shaft 140 through a chain and may be configured to rotate and may correspond to an element of the reducer 300.

Further, the second rotation member 134 may be a portion of the reducer 300 coupled to the cam shaft 150. The second rotation member 134 may be gear-coupled to the first rotation member 132 at a gear ratio in the reducer 300 and may be configured to rotate along with the cam shaft 150. Therefore, a rotation speed of the second rotation member 134 may be difficult to sense by the sensor 200 disposed external to the reducer 300. However, in the exemplary embodiment, the reducer 300 may further include an extension component 330 that protrudes from the second rotation member 134 or the cam shaft 150 to an arc-shaped slot 133 of the first rotation member 132 and may be exposed in a direction from the arc-shaped slot 133 to the sensor 200. For example, the reduce may be configured to rotate along with the cam shaft 150 or the second rotation member 134 in synchronization with the cam shaft 150 or the second rotation member 134. The extension component 330 may be provided in plurality, based on the number (e.g., three) of the second projections 320. The number of the extension components 330 and the number of the second projections 320 may be changed based on a desired precision of sensing.

Moreover, the sensor 200 may be coupled to the casing of the motor 124 and may be configured to perform a sensing operation toward the reducer 300 during rotation of the reducer 300. For example, the sensor 200 may perform a time-serial rotation speed sensing operation for example, repeating an operation of sensing a rotation speed of the first projection 310, successively sensing a rotation speed of the second projection 320 disposed in the second rotation member 134 and again sensing the rotation speed of the first projection 310. Accordingly, in order to correspond to a rotation speed, the sensor 200 may be configured to generate a sensing signal having a series of output waveforms and may be configured to input the sensing signal to the intelligent motor controller 122 of the motor 120.

The intelligent motor controller 122 may be configured to detect an actual phase angle APA (θ) from the rotation speed of the reducer 300, based on the sensing signal generated by the sensor 200. In other words, the intelligent motor controller 122 may be configured to receive the sensing signal from the sensor 200 to separate the crank shaft position signal CKP that corresponds to a rotation of the first projection 310 and the cam shaft position signal CMP that corresponds to a rotation of the second projection 320 from the sensing signal. Further, the crank shaft position signal CKP and the cam shaft position signal CMP may be compared to detect the actual phase angle APA (θ) of the suction valve or the exhaust valve. A phase deviation may be calculated between the detected actual phase angle APA (θ) and the predetermined target phase angle TPA (θ).

The intelligent motor controller 122 may be configured to output the driving current to adjust the relative rotation speed of the motor 124 with respect to the rotation speed of the cam shaft 150 based on the calculated phase deviation. A detailed description of the intelligent motor controller 122 will be described in detail with reference to FIG. 1 or 2. The reducer 300 may include the first rotation member 132 is mechanically coupled to the crank shaft 140 through a chain of the crank shaft 140 and may be configured to rotate. The second rotation member 134 is mechanically coupled to the cam shaft 150 and may be configured to rotate. The reducer 300 may be a gear box, a cam phase converter or a differential reducer.

The first and second rotation members 132 and 134 may be gear-coupled to each other at a predetermined reduction gear ratio (e.g., a gear ratio). The technical feature according to an exemplary embodiment of the present invention does not correspond to a gear coupling structure 135 between the first and second rotation members 132 and 134 but corresponds to that the sensor 200 disposed in the motor 124 and configured to sense a rotation speed of each of the first and second rotation members 132 and 134. Accordingly, a detailed description of the gear coupling structure 135 is omitted. The reducer 300 may be configured to perform an addition or a subtraction operation on the motor torque MT transferred from the motor 124 and a crank torque CT transferred through the chain of the crank shaft 140 based on the reduction gear ratio (e.g., the gear ratio) to generate an output torque ST and may transfer the output torque ST to the cam shaft 150. The cam shaft 150 may include a variation of a valve timing of the suction valve or the exhaust valve via a rotation phase controlled based on the output torque ST transferred from the reducer 300. Further, a valve of the rotation phase controlled based on the output torque ST may be the equal to a rotation phase obtained through a rotation of the cam shaft 150 or a rotation of the second projection 320 (e.g., the second projection 320 adjusted while drawing an arc shape along a circumferential direction within a finite angle range).

Figure 2:
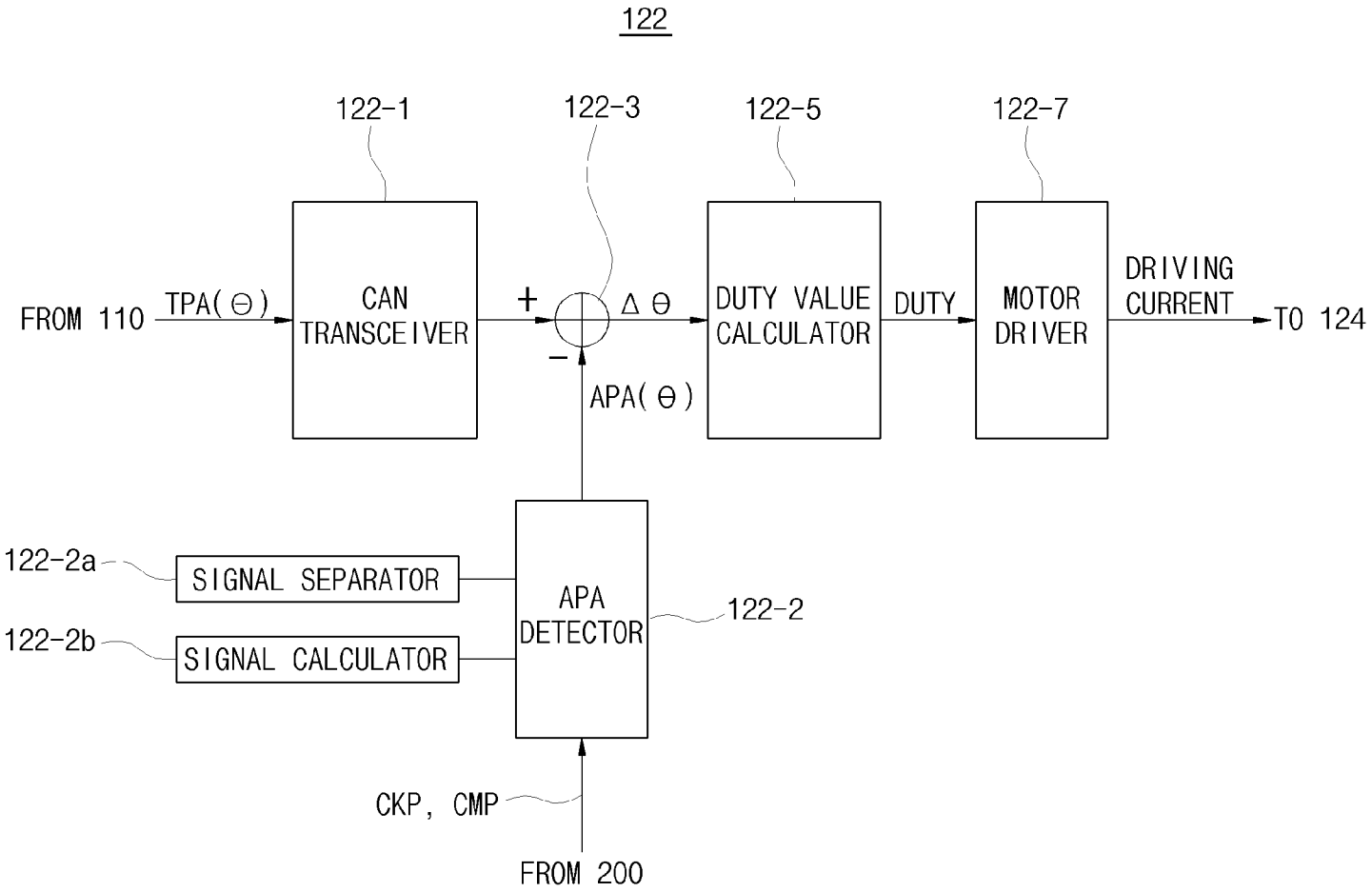
FIG. 2 is an exemplary block diagram illustrating an internal configuration of an intelligent motor controller illustrated in FIG. 1 according to an exemplary embodiment of the present invention.

FIG. 2 is an exemplary block diagram illustrating an internal configuration of the intelligent motor controller 122 illustrated in FIG. 1. Referring to FIG. 2, the intelligent motor controller 122 may be integrated with (e.g., built into) the motor 124 and may be configured to perform a motor control operation that may include a motor duty ratio calculation conventionally performed by the ECU 110. In particular, the intelligent motor controller 122 may include a CAN transceiver 122-1, an actual phase angle (APA) detector 122-2, a subtractor 122-3, a duty value calculator 122-5, and a motor driver 122-7.

The CAN transceiver 122-1 may be configured to receive the target phase angle TPA (θ) from the ECU 110 through CAN communication in a vehicle and may be configured to output the received target phase angle TPA (θ) to the subtractor 122-3. The APA detector 122-2 may include a signal separator **122-2*a* that may be configured to separate the crank shaft position signal CKP and the cam shaft position signal CMP from an output waveform that corresponds to the sensing signal received from the sensor 200. Further, a signal operator 122-2*b* may be configured to perform an arithmetic operation or a comparison operation on the crank shaft position signal CKP and the cam shaft position signal CMP to detect the actual phase angle APA (θ). The subtractor 122-3 may be configured to calculate a phase deviation "Δθ" between the target phase angle TPA (θ) supplied from the CAN transceiver 122-1 and the actual phase angle APA (θ) supplied from the APA detector 122-2**.

The duty value calculator 122-5 may be configured to determine an addition or subtraction torque value for an output torque of the cam shaft 150 based on the phase deviation "Δθ" from the subtractor 122-3, a control unit time and the reduction gear ratio (e.g., the gear ratio) and may be configured to calculate a duty value DUTY that corresponds to the addition or subtraction torque value. The duty value may be configured to be transferred to the motor driver 122-7 to adjust the position of the cam shaft 150 to a relative leading angle (e.g., an advance angle) or a relative lagging angle (e.g., a late angle).

In particular, the addition or subtraction torque value for the motor 124 may be set by using the following Equation (1):

$$\Delta\theta \propto 2 \cdot CT + Z \cdot MT \cdot \varepsilon \quad (1)$$

where Δθ denotes a desired phase variation rate of the cam shaft, CT denotes the crank torque, Z denotes a reduction gear ratio of the reducer, MT denotes the motor torque, and ε denotes transmission efficiency.

The motor driver 122-7 may be configured to calculate a duty ratio that corresponds to the phase deviation "Δθ" from a duty value transferred from the duty value calculator 122-5 and may be configured to generate a driving current that corresponds to the calculated duty ratio. The generated driving current may be output to the motor 124 to adjust at least one of a rotational direction, a rotation speed, and a torque of the motor 124. The intelligent motor controller 122 may be configured to autonomously perform phase control even when an operation failure of the ECU 110, the stop of start of an engine or excessively low revolutions of the engine occurs due to a malfunction or a vehicle accident. Accordingly, the target phase angle TPA (θ) is not supplied from the ECU 110. In other words, when the intelligent motor controller 122 cannot receive the target phase angle TPA (θ) from the ECU 110, the intelligent motor controller 122 may be configured to output the driving current by using the actual phase angle APA (θ) or may be configured to determine the actual phase angle APA (θ) to a default vale. Accordingly, the driving current may be output that corresponds to the default value. As described above, the intelligent motor controller 122 may independently operate.

Figure 3:
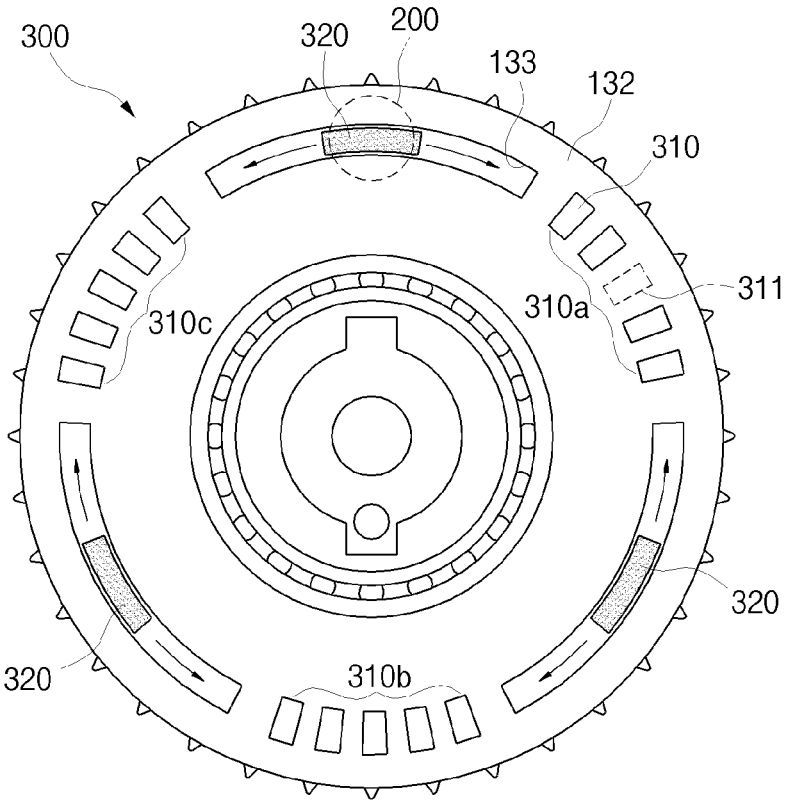
FIG. 3 is an exemplary side view of a reducer facing a motor with respect to line A-A illustrated in FIG. 1 according to an exemplary embodiment of the present invention.

FIG. 3 is an exemplary side view of the reducer 300 facing the motor 124 with respect to line A-A illustrated in FIG. 3. Referring to FIG. 3, the first projection 310 may be provided in plurality. The plurality of first projections 310 may be disposed along a circumferential direction on a side of the first rotation member 132 facing the motor 124 and may be spaced apart from each other. The first projections 310 may be individual components of a plurality of projection groups 310*a* to 310*c* which are disposed at a spacing angle (e.g., 120 degrees) with respect to a center of the first rotation member 132. The circumferential direction may correlate to a region sensed by the sensor 200.

In particular, the number of the first projections 310 or the number of the projection groups 310*a* to 310*c* may increase or decrease based on a precision of the sensor 200. Further, in the projection groups 310*a* to 310*c*, one or two of the first projections 310 may be omitted for marking a reference point or a top dead point of a piston coupled to a crank shaft. For example, in FIG. 3, a first projection 310 may be illustrated as being omitted, however based on a design two first projections 310 may be omitted. In other words, a portion where a projection is omitted may be referred to as a missing tooth 311. For example, when a sensing region of the sensor 200 reaches the missing tooth 311 when the reducer 300 is configured to rotate, a voltage waveform induced from the sensor 200 may be distorted and the intelligent motor controller 122 may be configured to determine the reference point or the top dead point. The missing tooth 311 may be used in the exemplary embodiment, but is not limited thereto. In other exemplary embodiments, an interval between the first projections 310 may maintain an equal interval and then may maintain an unequal interval at a position that corresponds to the reference point or the top dead point, and an equivalent recognition effect may be obtained.

Further, the first rotation member 132 may include the arc-shaped slot 133 disposed between the projection groups 310*a* to 310*c*. The arc-shaped slot 133 may be disposed in plurality and the plurality of arc-shaped slots 133 may be arranged at a particular arrangement angle (e.g., 120 degrees) along a circumferential direction in the same direction in which the first projections 310 may be arranged on the side of the first rotation member 132 facing the motor 124.

In particular, the second projection 320 may have a length that may be less than an aperture length of the arc-shaped slot 133. The second projection 320 may be exposed to the exterior through the arc-shaped slot 133 and the position there of may be sensed by the sensor 200. The second projection 320 may have a shape differentiated from the first projection 310. The second projection 320 may have a rotation phase similar to a rotation phase of the cam shaft 150 in the arc-shaped slot 113. In other words, the second projection 320 may be disposed in plurality and each of the plurality of second projections 320 may translate along the arc-shaped slot 133 at a rotation angle similar to the rotation angle of the cam shaft 150.

As described above, in the electronic CVVT control apparatus 100 according to an exemplary embodiment of the present invention an operational load associated with CVVT control performed by a conventional ECU may be distributed to the intelligent motor controller 122 integrated with (e.g., built into) the motor 124. Accordingly, an operational load of the ECU 110 may be significantly reduced. Further, by using o the sensor 200, an operation processing speed may be improved.

Figure 4:
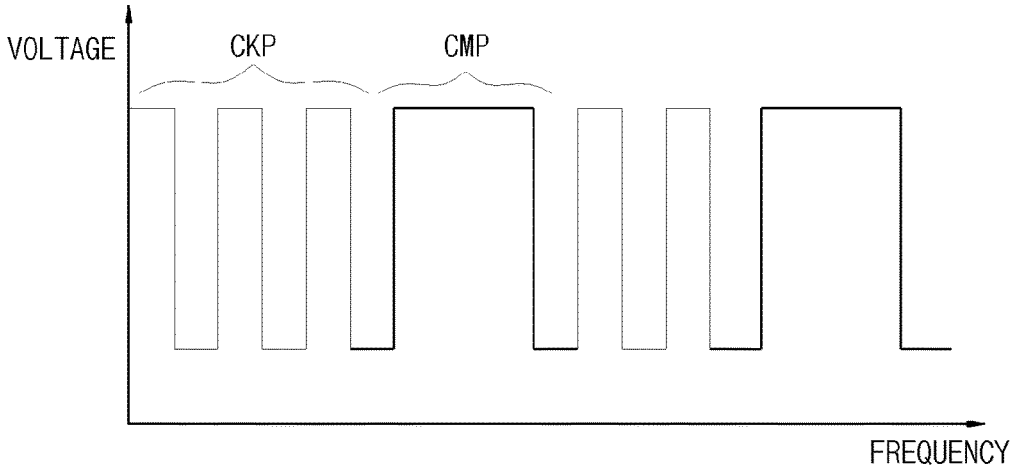
FIG. 4 is an exemplary output waveform diagram of one sensor illustrated in FIG. 1 according to an exemplary embodiment of the present invention.
Figure 5:
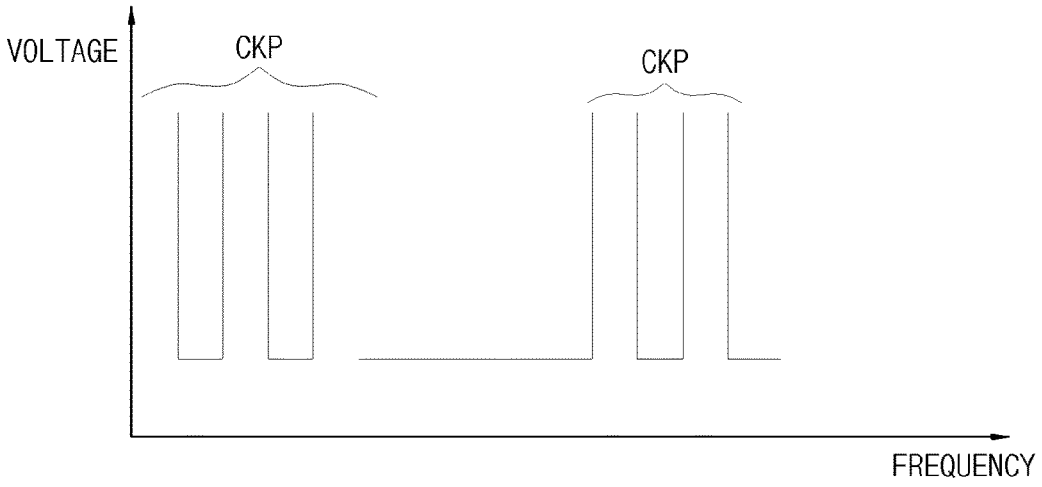
FIG. 5 is a waveform diagram of a crank shaft position signal separated from the output waveform diagram shown in FIG. 4.
Figure 6:
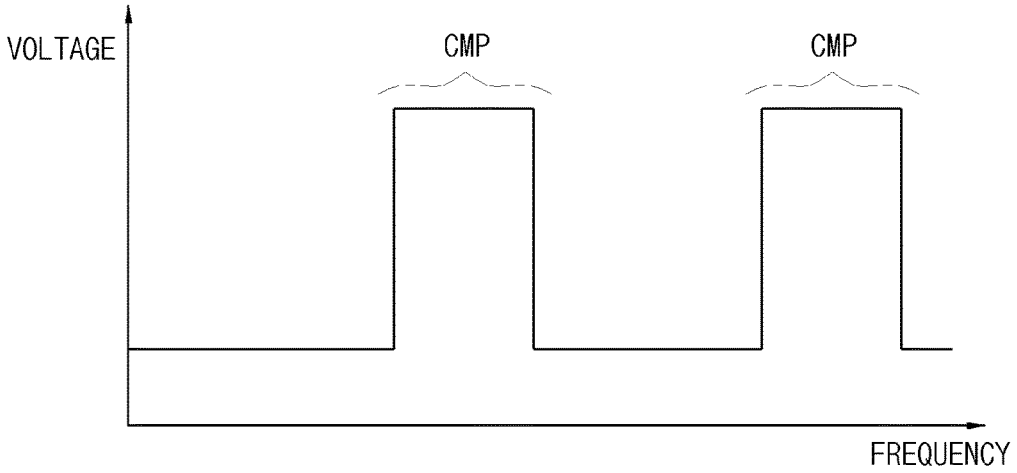
FIG. 6 is an exemplary waveform diagram of a cam shaft position signal separated from the output waveform diagram shown in FIG. 4 according to an exemplary embodiment of the present invention.

FIG. 4 is an exemplary output waveform diagram of the sensor 200 illustrated in FIG. 1. FIG. 5 is an exemplary waveform diagram of the crank shaft position signal separated from the output waveform diagram shown in FIG. 4. FIG. 6 is an exemplary waveform diagram of the cam shaft position signal separated from the output waveform diagram shown in FIG. 4. Referring to FIGS. 2 to 6, the sensing signal received from the sensor 200 may correspond to an output waveform that shows a component of the crank shaft position signal CKP and a component of the cam shaft position signal CMP that may be continuously or repeatedly output with time. For example, the abscissa axis of the output waveform may denote a frequency and the ordinate axis may denote a voltage.

The component of the crank shaft position signal CKP may correspond to a frequency waveform which is relatively narrow in frequency width and may be based on a projection shape of the first projection 310 having a relatively short length or narrow width. The component of the cam shaft position signal CMP may correspond to a frequency waveform which is relatively broad in frequency width and may be based on a projection shape of the second projection 320 having a greater arc-shaped length than the first projection 310. In other words, in an output waveform the component of the crank shaft position signal CKP and the component of the cam shaft position signal CMP may be differentiated from each other.

Therefore, the signal separator 122-2*a* of FIG. 2 may be configured to separate a frequency waveform that corresponds to the crank shaft position signal CKP shown in FIG. 5 and a frequency waveform corresponding to the cam shaft position signal CMP shown in FIG. 6 from the output waveform. Accordingly, the signal separator 122-2*b* may be configured to perform an arithmetic operation (e.g., a comparison operation) on the crank shaft position signal CKP that may include the frequency waveform of FIG. 5 and the cam shaft position signal CMP. In particular, the frequency waveform of FIG. 6, may be separated from the output waveform by the signal separator 122-2*a* to detect the actual phase angle APA (θ).

Figure 7:
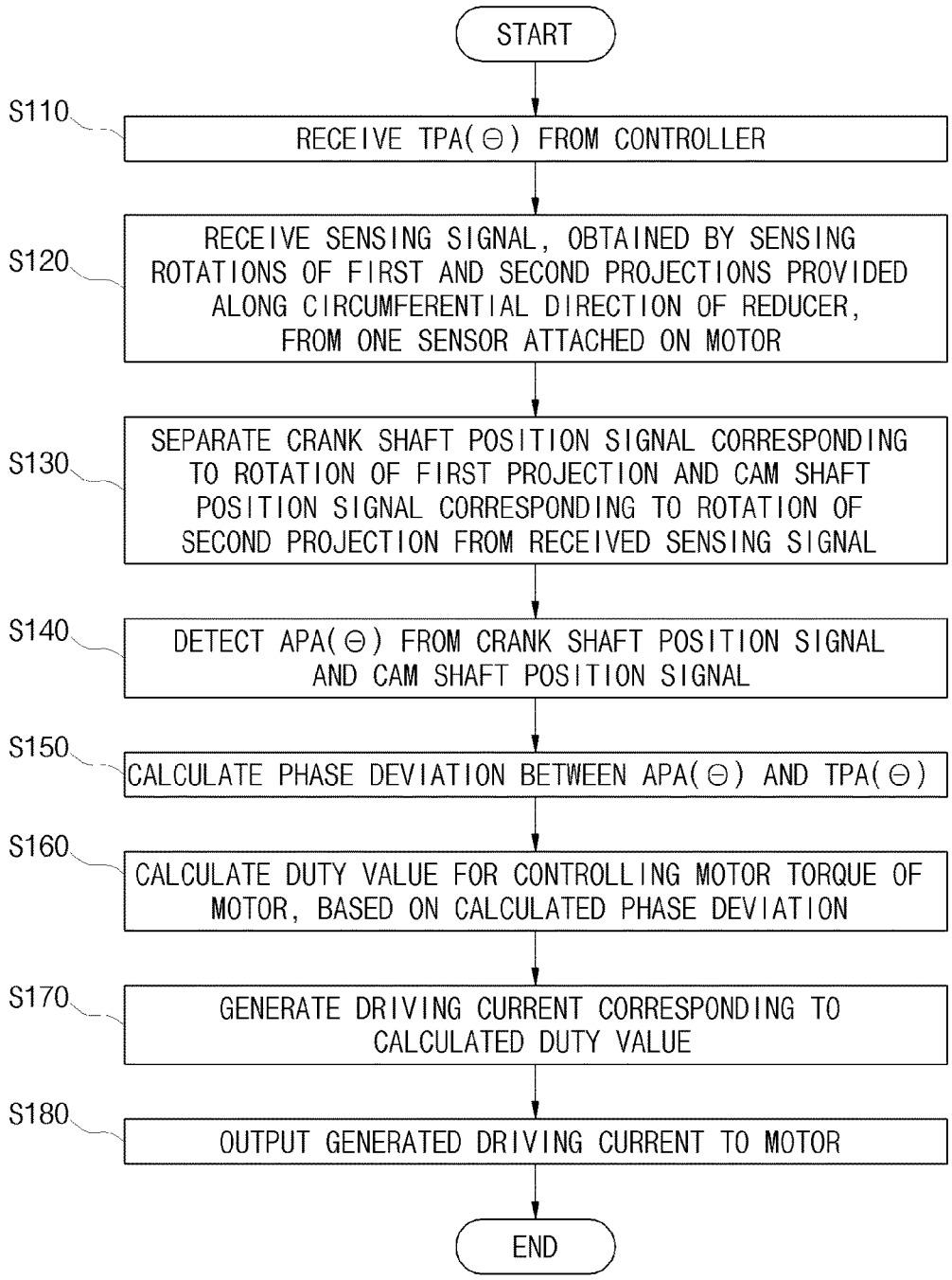
FIG. 7 is an exemplary flowchart illustrating an electric CVVT control method performed by the electric CVVT control apparatus of FIG. 1 according to an exemplary embodiment of the present invention.

Hereinafter, an electric CVVT control method according to the exemplary embodiment will be described in detail. FIG. 7 is an exemplary flowchart illustrating an electric CVVT control method performed by the electric CVVT control apparatus of FIG. 1. Referring to FIG. 7, the intelligent motor controller built into (e.g., integrated with) the motor may be configured to receive the target phase angle TPA (θ) from the ECU through the vehicle network communication such as the CAN communication (S110). The sensor attached on the motor may be configured to sense a rotation speed of the first projection disposed in the first rotation member which is coupled to the crank shaft to rotate and may be configured to time-serially sense a rotation speed of the second projection disposed in the second rotation member which is gear-coupled to the first rotation member at a certain gear ratio. Accordingly, a sensing signal that corresponds to an output waveform may be generated. Additionally, the intelligent motor controller may be configured to receive the sensing signal from the sensor (S120).

Further, the signal separator of the intelligent motor controller may be configured to separate the crank shaft position signal CKP that corresponds to the rotation of the first projection and the cam shaft position signal CMP that corresponds to the rotation of the second projection from the sensing signal (S130). The signal separator of the intelligent motor controller may be configured to detect the actual phase angle APA (θ) by using the crank shaft position signal CKP and the cam shaft position signal CMP. For example, a method of calculating or detecting the actual phase angle APA (θ) by using the crank shaft position signal CKP and the cam shaft position signal CMP may include a method generalized in CVVT control and may be omitted in describing the present embodiment. Additionally, the actual phase angle APA (θ) may be supplied to the subtractor (S140).

The subtractor of the intelligent motor controller may be configured to calculate a phase deviation between the detected actual phase angle APA (θ) and the predetermined target phase angle TPA (θ) (S150). The intelligent motor controller may be configured to calculate a duty value to adjust the motor torque of the motor based on the calculated phase deviation (S160). The intelligent motor controller may be configured to generate a driving current that corresponds to the calculated duty value (S170). Further, the generated driving current may be configured to be output to the motor and the motor torque of the motor may be adjusted (S180).

In the exemplary embodiment, a process of calculating a duty value may include receiving the predetermined target phase angle TPA (θ) from a controller through a digital serial communication of CAN communication and RS-485 communication (S110), detecting the actual phase angle APA (θ) based on the crank shaft position signal CKP and the cam shaft position signal CMP detected by the sensor (S120 to S140), calculating a phase deviation between the actual phase angle APA (θ) and the target phase angle TPA (θ) (S150), and setting an addition or subtraction torque value for an output torque of a cam shaft based on the calculated phase deviation and calculating a duty value corresponding to the addition/subtraction torque value (S160). According to the exemplary embodiments of the present invention, since the intelligent motor controller receives a sensing signal including a plurality of different signals from one sensor to determine a crank shaft position signal and a cam shaft position signal, the timing may be rapidly and accurately controlled.

Moreover, according to the exemplary embodiments of the present invention, since the intelligent motor controller integrated with an electric motor may be configured to perform an arithmetic operation conventionally performed by an ECU for controlling a motor in collaboration with the ECU or independently performs the arithmetic operation when an operation of the ECU fails, an operational load conventionally performed by the ECU may be reduced. For example, even in an urgent situation (e.g., operation failure of the ECU), the intelligent motor controller may autonomously perform phase control and a valve timing may be rapidly and precisely controlled even when the start of an engine is terminated or revolutions of the engine are low.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An apparatus for controlling an electronic continuously variable valve timing (CVVT) comprising:

a motor and a reducer, configured to adjust a relative rotation phase of a cam shaft that rotates with a crank shaft of a combustion engine to adjust a valve timing of a suction valve or an exhaust valve;

a sensor disposed in a border of a side of the motor facing the reducer configured to determine a rotation speed of a first projection of a first rotation member which is coupled to the crank shaft to rotate;

a second projection of a second rotation member having a rotation speed configured to be determined by the sensor which is gear-coupled to the first rotation member at a certain gear ratio and is coupled to the cam shaft to rotate, wherein the sensor is configured to output a sensing signal that corresponds to an output waveform which corresponds to each of the rotation speeds; and an intelligent motor controller coupled to the motor, wherein the intelligent motor controller is configured to receive the sensing signal from the sensor, separate a crank shaft position signal that corresponds to a rotation of the first projection and a cam shaft position signal that corresponds to a rotation of the second projection from the sensing signal, compare the crank shaft position signal and the cam shaft position signal to detect an actual phase angle of the suction valve or the exhaust valve, and determine a phase deviation between the detected actual phase angle and a predetermined target phase angle, wherein the first projection and the second projection are disposed along a circumferential direction of a side of the reducer facing the motor.

2. The apparatus of claim 1, wherein the first projection is included in one of a plurality of projection groups, wherein the plurality of projection groups are disposed along the circumferential direction on a side of the first rotation member facing the motor and are spaced apart from each other, and wherein the plurality of projection groups are disposed at a spacing angle with respect to a center of the first rotation member.

3. The apparatus of claim 2, wherein the first rotation member includes an arc-shaped slot disposed between adjacent ones of the plurality of projection groups.

4. The apparatus of claim 3, wherein the second projection has an arc-shaped length that is greater than an arc-shaped length of the first projection and is configured to be adjusted along the arc-shaped slot at a rotation angle which is similar to a rotation angle of the cam shaft.

5. The apparatus of claim 3, wherein the second projection has a length less than an aperture length of the arc-shaped slot, and the second projection is exposed through the arc-shaped slot and is sensed by the sensor.

6. The apparatus of claim 1, the intelligent motor controller further comprising:

an actual phase angle (APA) detector, the APA detector that includes, a signal separator configured to separate the crank shaft position signal and the cam shaft position signal from the output waveform that corresponds to the sensing signal; and a signal operator configured to perform an arithmetic operation or a comparison operation on the crank shaft position signal and the cam shaft position signal to detect the actual phase angle.

7. The apparatus of claim 1, wherein the reducer is a gear train or a general reducer having planetary gears.

8. The apparatus of claim 1, further comprising:

a sensor installation component, at which the sensor is disposed, provided on a first side of a casing of the motor; and a controller installation component, at which the intelligent motor controller is disposed, provided on a second side of the casing.

9. An electronic continuously variable valve timing (CVVT) control method performed by an electronic CVVT control apparatus comprising:

actuating a motor and a reducer to adjust a relative rotation phase of a cam shaft in cooperation with a crank shaft of a combustion engine to adjust a valve timing of a suction valve or an exhaust valve;

sensing, by a sensor coupled to the motor, a rotation speed of a first projection of a first rotation member which is coupled to the crank shaft to rotate, sensing in a time-serialized sequence a rotation speed of a second projection of a second rotation member which is gear-coupled to the first rotation member at a certain gear ratio and is coupled to the cam shaft to rotate;

generating a sensing signal having an output waveform that corresponds to the rotation speed of the first projection and the rotation speed of the second projection;

inputting the sensing signal to an intelligent motor controller coupled to the motor;

separating a crank shaft position signal that corresponds to the rotation speed of the first projection and a cam shaft position signal that corresponds to the rotation speed of the second projection from the sensing signal by using a signal separator of the intelligent motor controller;

comparing the crank shaft position signal and the cam shaft position signal to detect an actual phase angle of the suction valve or the exhaust valve by using a signal calculator;

determining a phase deviation between the detected actual phase angle and a predetermined target phase angle; and determining, by the intelligent motor controller, a duty value to adjust a motor torque of the motor, based on the determined phase deviation.

10. The electronic CVVT control method of claim 9, the determining of the duty value further comprises:

receiving the predetermined target phase angle via a digital serial communication of controller area network (CAN) communication and RS-485 communication;

detecting the actual phase angle by using the crank shaft position signal and the cam shaft position signal from the sensor;

determining the phase deviation between the target phase angle and the actual phase angle;

setting an addition or subtraction torque value for an output torque of the cam shaft, based on the calculated phase deviation; and determining a duty value corresponding to the addition or subtraction torque value.

* * * * *